United States Patent [19]

Tiletschke et al.

[11] Patent Number: 4,468,907

[45] Date of Patent: Sep. 4, 1984

[54] DEVICE FOR PROTECTING STEEL REINFORCEMENTS FOR CONCRETE AS WELL AS A METHOD AND DEVICE FOR PRODUCING THEM

[75] Inventors: Lothar Tiletschke; Hellmuth Feldmann, both of Bielefeld, Fed. Rep. of Germany

[73] Assignee: Signma Bauelemente GmbH, Bielefeld, Fed. Rep. of Germany

[21] Appl. No.: 459,495

[22] Filed: Jan. 20, 1983

[30] Foreign Application Priority Data

Jan. 22, 1982 [DE] Fed. Rep. of Germany ..... 3201918

[51] Int. Cl.[3] ..... E04B 1/41; E04C 1/00

[52] U.S. Cl. ..... 52/333; 52/378

[58] Field of Search ..... 52/333, 699, 378, 701, 52/606; 249/188; 264/46.7

[56] References Cited

U.S. PATENT DOCUMENTS 4,010,586 3/1977 Brechbuhler ..... 52/378 X
4,325,533 4/1982 Tiletschke et al. .
4,338,757 7/1982 Witschi et al. ..... 52/699

FOREIGN PATENT DOCUMENTS 3127087 1/1983 Fed. Rep. of Germany .

*Primary Examiner*—J. Karl Bell
*Attorney, Agent, or Firm*—Cushman, Darby & Cushman

[57] ABSTRACT

A protective device (12) for steel reinforcements (16) includes a bottom box (22) and a cover (24) which can be inserted into it. In the bottom (26) of the bottom box there are slots (32) through which parts (18) of the steel reinforcements (16) which project out of the closed protective device can be inserted. The side walls of the cover are designed as double layers and form an interspace (56) which makes it possible to weld the outer layer (54) and the side walls (28, 30) of the bottom box using tools that grip from both sides.

13 Claims, 9 Drawing Figures

DEVICE FOR PROTECTING STEEL REINFORCEMENTS FOR CONCRETE AS WELL AS A METHOD AND DEVICE FOR PRODUCING THEM

DESCRIPTION

Device for protecting steel reinforcements for joint regions of concrete structures in the form of an elongated, flat bottom box that is open at the top and the bottom has slots to receive angle-shaped anchorage areas of the steel reinforcements inserted into the bottom box, and a box-shaped cover which closes the device. Moreover, this invention also concerns a process for producing such a device, as well as a device for carrying out this process.

A device of the type according to this invention is described in previous patent application P No. 31 27 087.5 by the present applicant. The reader is also referred to German Patent Application No. 2,934,189.7-25, also by the present applicant, regarding the state of the art.

Devices of the type according to this invention are used in concrete construction to produce wall junctions, etc. They are used to produce a continuous steel reinforcement in the joint region of two walls in a concrete wall structure with a T-shaped cross section. Since the walls to be joined are usually poured one after the other in succession, steel reinforcements that project at the side are anchored first in the wall that is produced first and the projecting areas are then embedded in the second wall which is produced next. The areas of the steel reinforcements embedded in the wall produced first will be referred to below as anchorage areas, and the areas intended for the wall that is produced next shall be referred to as the steel reinforcement joint regions. Protective devices of the type according to this invention are used to shield the joint regions of the steel reinforcements within the concrete form of the wall produced next to protect the reinforcements from the concrete in this wall. After removing the concrete form, the joint regions can thus easily be bent out at a right angle.

This invention is based on the task of improving the device according to this invention with regard to machine production, i.e., automation.

This goal is achieved according to this invention by having the side walls of the cover designed as double layers, forming an interspace which is open toward the top surface of the cover.

The double layer design of the side walls of the cover offers the advantage that the outer layer can be indented without altering the actual inside space of the cover. The cover can therefore easily be pressed into the bottom box, even by machine, without making any high demands regarding manufacturing accuracy. Moreover, the interspace between the layers of the side walls of the cover permits the use of welding tongs and similar tools to weld the outer layer to the side walls of the bottom box, e.g., in a number of spot welds. Therefore, this protective device can also easily be closed with an automatic welding device.

The two layers of the side walls of the cover preferably diverge in a V-shape toward the open side of the interspace, and the side walls of the bottom box are inclined outward at a corresponding angle. This greatly facilitates placement of the cover in the bottom box.

Crossbars running across the longitudinal direction of the protective device can be provided on the inside face of the bottom of the bottom box and the opposite inside face of the cover to shore up the joint regions of the steel reinforcements. The bottom box and the cover can easily be drawn from a plastic sheet in an especially simple way.

With the process according to this invention, the bottom boxes and covers are first produced in a preceding stage, e.g., by drawing a plastic sheet, and then sent to an assembly line. The assembly line has a first station where the steel reinforcements for a device are collected in a master plate with flat joint regions and anchorage areas projecting outward at a right angle, and the steel reinforcements are held in the position which they will assume in the finished protective device. The collected steel reinforcements are then rotated by 180° and pressed with their anchorage areas through the slots in the bottom of a bottom box that has been prepared for use. Then a cover is lowered onto the bottom box that has been filled with the steel reinforcements and pressed into the bottom box. Finally, the outer layers of the side walls of the cover are welded to the side walls of the bottom box.

The device according to this invention for carrying out the process according to this invention includes an assembly line with a number of successive stations. In the first station, there is a master plate in which the steel reinforcements are collected in the position intended for the protective device. The master plate can be pivoted with the help of a turnover device to a laterally inverted, downstream position in which the steel reinforcements are pressed with their anchorage areas through the slots of a bottom box that has been prepared for use. In the next station, a cover is lowered onto the bottom box and pressed into it, and in another station the outer layer of the side walls of the cover and the side walls of the bottom box are welded together.

Preferred practical examples of this invention are described in greater detail below with reference to the accompanying figures.

Figure 3:
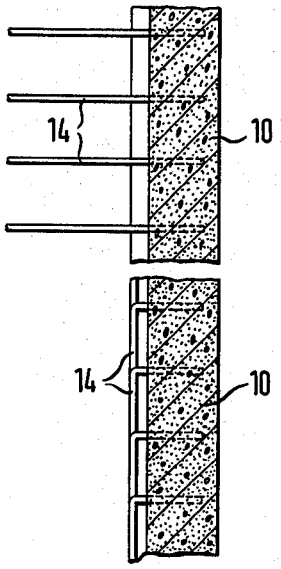
FIG. 3 shows a view perpendicular to FIG. 2.
Figure 2:
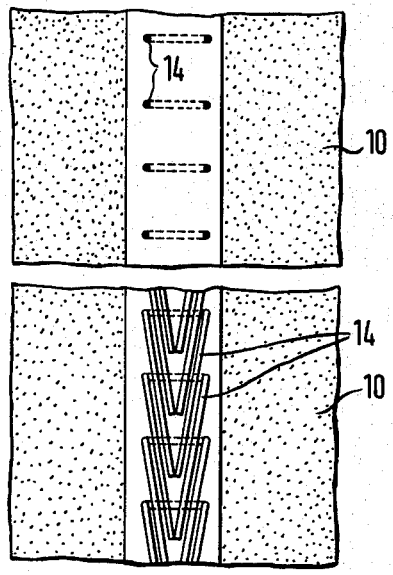
FIG. 2 shows a view according to arrow 2 in FIG. 1.
Figure 1:
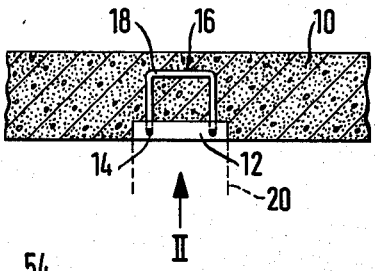
FIG. 1 shows a horizontal section through a concrete wall with embedded steel reinforcements and a protective device according to this invention.

FIG. 1 shows a partial horizontal section through a concrete wall 10 after removing the concrete form (not shown). A boxshaped protective device 12 is shown in cross section. Before pouring the concrete, the protective device 12 is tacked to the concrete form with nails, etc. Joint regions 14 of steel reinforcements 16 with an overall U-shape are embedded in protective device 12. These joint regions 14 run essentially perpendicular to the plane of the drawing in FIG. 1, as shown by a comparison with the lower diagrams in FIGS. 2 and 3. U-shaped anchorage areas 18 project out of the protective device 12 into the concrete of concrete wall 10. As shown by the top diagram in FIG. 3 in particular, joint regions 14 of the steel reinforcements can be bent out at a right angle from the concrete wall 10 after removing the concrete form and opening or removing protective device 12. Joint regions 14 are then embedded in the concrete of a joining wall 20 (shown with dotted lines in FIG. 1) in a subsequent operation.

Figure 4:
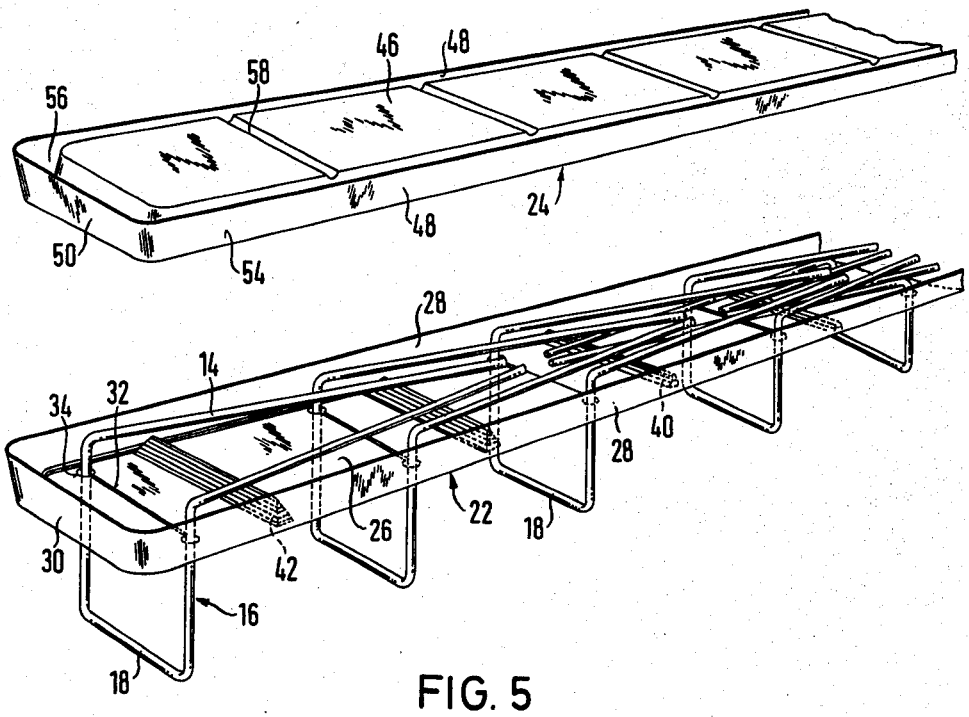
FIG. 4 shows a partial view of the holding device according to this invention with the cover raised.

FIG. 4 shows a protective device according to this invention in the open position with a bottom box, a cover 24 and a number of steel reinforcements 16. The shape and arrangement of the steel reinforcements per se are already known and will therefore be mentioned only briefly. The steel reinforcements are bent in a U-shape on the whole and are also bent at a right angle to the plane of the U. The U-shaped stirrups projecting downward in FIG. 4 represent the anchorage areas 18 for anchoring in the concrete wall produced first. The remaining free ends are the joint regions 14 for the joining wall. Joint regions 14 are bent together at an angle, thus permitting the staggered arrangement shown in FIG. 4. In the vicinity of the protective device shown at the left in FIG. 4, the joint regions 14 point to the right. The opposite arrangement is provided from the other end of the protective device (not shown in FIG. 4) so that joint regions 14 cross in the center area of the protective device, as indicated in FIG. 4.

Figure 6:
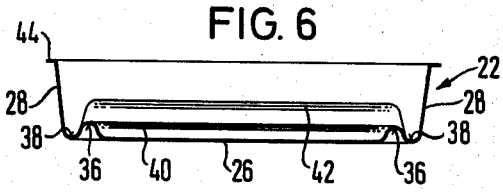
FIG. 6 shows a cross section through the bottom box.

The bottom box 22 has a bottom 26 and long side walls 28 plus front walls 30. Side walls 28 and 30 slope slightly outward, as shown in FIG. 6. Slots 32 run at intervals in the bottom 26 across the longitudinal direction of the bottom box and widen at both ends to form circular openings 34. The anchorage areas 18 of the steel reinforcements 16 can be pressed from above through these slots 32 and openings 34 until the joint regions 14 rest on the bottom 26 of the bottom box, as shown in FIG. 4.

In the bottom 26 there is also a raised reinforcing seam 36 inside the bottom box at a slight distance from the side walls around the periphery. This raised seam 36 stabilizes the bottom box and also serves to form a holding channel 38 for the cover, as explained below. In addition, there are raised crossbars 40 and 42 in the bottom 26 that run across the longitudinal direction. As shown in FIGS. 4 and 6, these crossbars have a greater height at the ends of the bottom box than in the middle region, because the joint regions 14, as mentioned above, cross each other in the middle of the protective device and require a greater height or clearance. Finally, the bottom box has a flange 44 which projects outward and runs along the side walls in order to further stabilize it.

Figure 5:
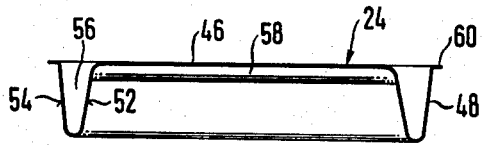
FIG. 5 shows a cross section through the cover.

Cover 24 is shown in FIG. 4 at the top and in FIG. 5. It is also designed in the form of a box and has a top surface 46 plus double-layer front and side walls 48 and 50. The inner layer 52 and the outer layer 54 of the side walls diverge in a V-shaped form toward the top surface 46, thus forming a V-shaped interspace 56 around the periphery of the cover. The shape of the cover and the position of the outer layers 54 of the side walls are such that the cover can be inserted into the bottom box in such a way that it does not overlap on the outside. The cover also has crossbars 58 that are sunk down to secure the joining regions 14. A flange 60 corresponds to flange 44 of the bottom box.

Figure 7:
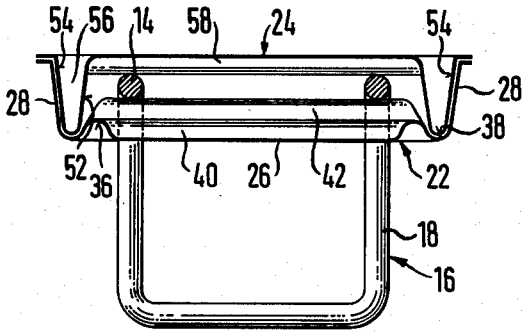
FIG. 7 shows a cross section through the protective device with the steel reinforcements inserted.

FIG. 7 shows a cross section after assembling the bottom box and cover. The double-layer side walls of cover 24 fit into the peripheral holding channel 38 of the bottom box (FIG. 6) and are secured there. The outer layers 54 of the side walls of the cover rest against side walls 28 and 30 of the bottom box. The interspace 56 formed between the two layers of the side walls of the cover make it possible to insert a flat iron or similar tool in ultrasonic welding of outer layers 54 and side walls 28.

Figure 8:
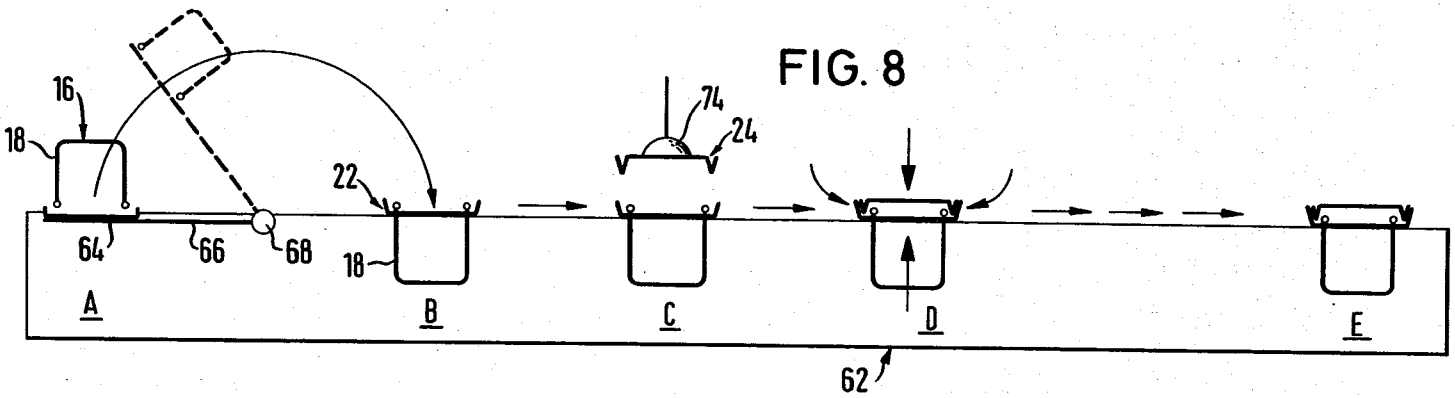
FIG. 8 shows a schematic longitudinal section of a device for producing a protective device according to this invention.
Figure 9:
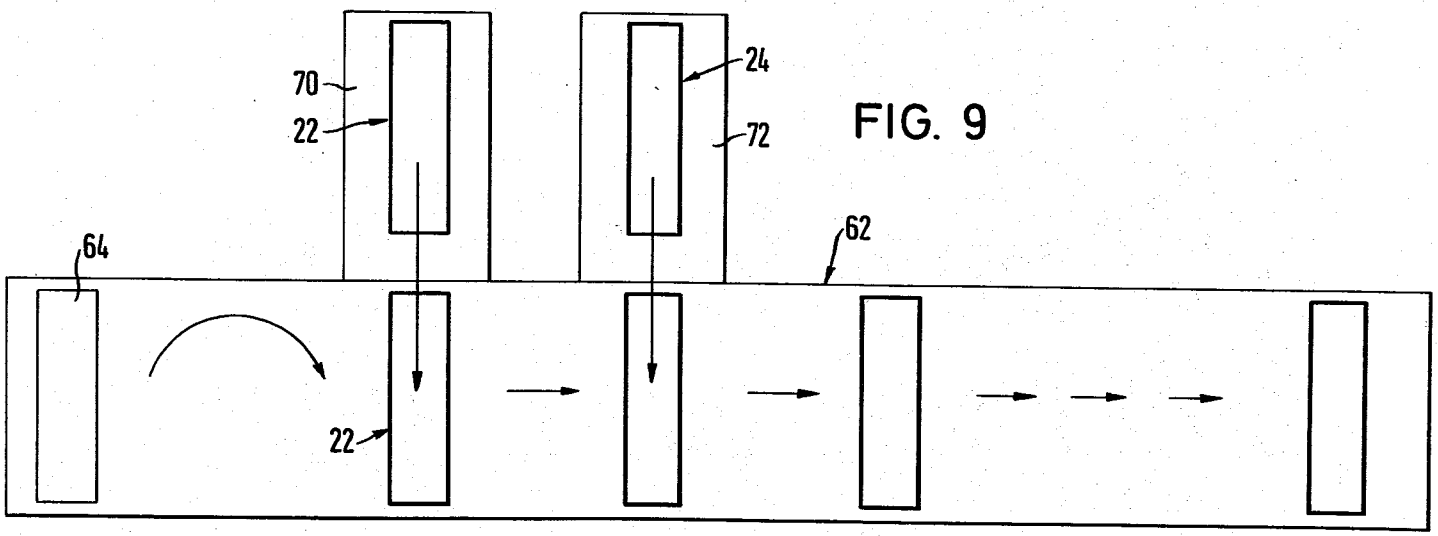
FIG. 9 shows a top view to FIG. 8.

FIGS. 8 and 9 illustrate production of a protective device according to this invention in a largely automated process on an assembly line indicated with 62 on the whole.

First, the steel reinforcements 16 are collected in a position opposite to that shown in FIG. 4, i.e., with the anchorage areas 18 projecting upward in the number and arrangement required for one protective device. The master plate 64 is connected by a swivel arm 66 with a rotating device 68 which takes hold of the master plate with the assembled steel reinforcements 16 and rotates them by 180° to a downstream position in the assembly line (as indicated with a dotted line and arrow in the figure), where they are inserted into a bottom box 22 which is supplied from magazine 70. The anchorage areas 18 of the steel reinforcements are inserted into slots 32 in the bottom 26 of the bottom box (FIG. 4). The stations described above, i.e., the collecting station equipped with master plate 64, the subsequent insertion station and then the following cover feed station, are labeled as A, B and C in FIG. 8. In the next station D, the bottom box and the cover are pressed together securely as indicated by the peripendicular arrows, while at the same time, the outer layers 54 of the side walls of the cover are welded to the side walls 28 of the bottom box, as shown in FIG. 7. Then the finished protective device is transferred to the discharge station E.

We claim:

1. Device for protecting steel reinforcements for joint regions of concrete structures in the form of an elongated, flat, bottom box that is open at the top and has slots in the bottom to hold angle-shaped anchorage regions of the steel reinforcements inserted into the bottom box, and a box-shaped cover that closes the device, characterized by the fact that the side walls (48, 50) of the cover (24) are in the form of a double layer and form an interspace (56) which is open toward the top surface (46) of the cover.

2. Device according to claim 1, characterized by the fact that the two layers (52, 54) of the side walls of the cover (24) diverge in a V-shape toward the top surface (46) of the cover, and the side walls (28, 30) of the bottom box (22) are inclined toward the outside.

3. Device according to claims 1 or 2, characterized by the fact that the bottom box (22) has a peripheral reinforcing seam (36) that is located a certain distance away from the side walls (28, 30) and is elevated in the direction of the interior of the box.

4. Device according to claim 1, characterized by the fact that means defining crossbars (40, 42) are provided in the bottom (26) of the bottom box to shore up joint regions (14) where the steel reinforcements (16) are joined.

5. Device according to claim 1 further including means defining crossbars (58) sunk into the interior of the cover so as to extend across the width of the cover (24) to shore up joint regions (14) where the steel reinforcements (16) are joined.

6. A device according to claim 2, further including means defining crossbars (40, 42) in the bottom (26) of the bottom box to shore up joint regions (14) where the steel reinforcements (16) are joined.

7. A device according to claim 3, further including means defining crossbars (40, 42) in the bottom (26) of the bottom box to shore up joint regions (14) where the steel reinforcements (16) are joined.

8. A device according to claim 2, further including means defining crossbars (58) sunk into the interior of the cover so as to extend across the width of the cover (24) to shore up joint regions (14) where the steel reinforcements (16) are joined.

9. A device according to claim 3, further including means defining crossbars (58) sunk into the interior of the cover so as to extend across the width of the cover (24) to shore up joint regions (14) where the steel reinforcements (16) are joined.

10. A device according to claim 4, further including means defining crossbars (58) sunk into the interior of the cover so as to extend across the width of the cover (24) to shore up joint regions (14) where the steel reinforcements (16) are joined.

11. A process for producing a device for protecting steel reinforcements for joint regions of concrete structures in the form of an elongated, flat, bottom box and a cover therefor comprising the steps of drawing a plastic sheet into a bottom box structure having a bottom surface provided with means defining a plurality of slots and upstanding side walls, drawing a plastic sheet into a cover structure having a main surface and an integrally formed upturned sidewall structure, moving the bottom in a predetermined manner along an assembly line, separately assembling a plurality of steel reinforcements, for use with the protective device, on a master plate having flat regions and perpendicular projecting anchorage areas, rotating the assembled reinforcements through 180° and positioning the assembled reinforcements into said bottom box so that at least portions of the steel reinforcements extend through the slots provided in the bottom box structure, positioning the cover on the bottom box structure so that the outer layer of the cover side walls lie adjacent the inside surfaces of the bottom box structure side walls, and welding the cover and bottom box side walls together.

12. Apparatus including a plurality of separate forming stations for producing a protected steel reinforcement for use with concrete structures including means defining a first station for collecting a plurality of steel reinforcements each having vertical and horizontally extending portions and for nesting at least a portion of the horizontal portions together and holding the steel reinforcements on a master forming plate so that the vertically extending portions extend upwardly away from the forming plate, said first station further including means for turning the master forming plate through 180° so that the assembled steel reinforcements can be inverted and released, means defining a second station downstream from said first station for positioning a bottom box structure including integrally formed side walls and a bottom surface, said bottom surface being provided with a plurality of slots so that the inverted steel reinforcements can be received in the bottom box structure with the vertical portions of the steel reinforcements passing through the slots, means defining a third station downstream from said second station for receiving the bottom box structure together with the inverted steel reinforcements therein and for placing a cover structure on said bottom box structure, and means defining a fourth station downstream from said third station for receiving the covered bottom box structure and for welding the bottom and cover structures together and means for moving the bottom box structure between said first, second, third and fourth stations.

13. Apparatus as in claim 12 further including a fifth station means downstream from said fourth station for discharging the protected steel reinforcement.

* * * * *